US011566634B2

(12) United States Patent
Fournier et al.

(10) Patent No.: US 11,566,634 B2
(45) Date of Patent: Jan. 31, 2023

(54) ARRANGEMENT OF CENTRIFUGAL IMPELLER OF A FAN FOR REDUCING NOISE

(71) Applicant: Carrier Corporation, Palm Beach Gardens, FL (US)

(72) Inventors: Francette Fournier, Bettant (FR); Gael Herve, Chambery (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/059,024

(22) PCT Filed: Oct. 29, 2019

(86) PCT No.: PCT/US2019/058479
§ 371 (c)(1),
(2) Date: Nov. 25, 2020

(87) PCT Pub. No.: WO2020/092311
PCT Pub. Date: May 7, 2020

(65) Prior Publication Data

US 2021/0270286 A1 Sep. 2, 2021

(30) Foreign Application Priority Data

Oct. 31, 2018 (EP) ..... 18306428

(51) Int. Cl.
*F04D 29/42* (2006.01)
*F04D 17/10* (2006.01)
(Continued)

(52) U.S. Cl.
CPC ..... *F04D 29/4213* (2013.01); *F04D 17/10* (2013.01); *F04D 25/08* (2013.01); *F04D 29/441* (2013.01); *F04D 29/667* (2013.01)

(58) Field of Classification Search
CPC ..... F04D 29/4213; F04D 17/10; F04D 25/08; F04D 29/441; F04D 29/662
See application file for complete search history.

(56) References Cited

U.S. PATENT DOCUMENTS 2,316,608 A * 4/1943 McMahan ..... F04D 29/668 415/213.1
5,813,831 A * 9/1998 Matsunaga ..... F04D 29/4213 415/206
(Continued)

FOREIGN PATENT DOCUMENTS

DE 1276858 B 9/1968
DE 3304963 A1 8/1984
(Continued)

OTHER PUBLICATIONS

Extended European Search Report; International Application No. 18306428.6-1007; International Filing Date: Oct. 31, 2018; dated Apr. 9, 2019; 8 pages.
(Continued)

*Primary Examiner* — Syed O Hasan
(74) *Attorney, Agent, or Firm* — Cantor Colburn LLP

(57) ABSTRACT

An interface of a centrifugal fan includes an inlet shroud of an impeller and an air intake positioned adjacent the inlet shroud. The inlet shroud and the air intake cooperate to define a smooth flow path for an airflow entering the centrifugal fan.

13 Claims, 3 Drawing Sheets

(51) Int. Cl.

| | |
|---|---|
| ***F04D 25/08*** | (2006.01) |
| ***F04D 29/44*** | (2006.01) |
| ***F04D 29/66*** | (2006.01) |

(56) References Cited

U.S. PATENT DOCUMENTS

| | | | | |
|---|---|---|---|---|
| 7,114,921 | B2 | 10/2006 | Iwasaki et al. | |
| 7,163,374 | B2 | 1/2007 | Lee et al. | |
| 7,214,033 | B2 | 5/2007 | Lee et al. | |
| 7,748,954 | B2 * | 7/2010 | Eguchi | F04D 29/162 416/185 |
| 8,915,698 | B2 | 12/2014 | Jeon et al. | |
| 9,267,511 | B2 | 2/2016 | Ikeda et al. | |
| 9,587,841 | B2 | 3/2017 | Cho et al. | |
| 9,752,816 | B2 | 9/2017 | Hwang et al. | |
| 10,024,332 | B2 | 7/2018 | Ohtaguro | |
| 2008/0279681 | A1 | 11/2008 | Eguchi et al. | |
| 2015/0354584 | A1 | 12/2015 | Iwata et al. | |
| 2016/0025109 | A1 * | 1/2016 | Katsumata | F04D 29/4213 415/206 |
| 2016/0102871 | A1 | 4/2016 | Yamasari | |
| 2016/0223211 | A1 | 8/2016 | Xue et al. | |
| 2017/0130723 | A1 * | 5/2017 | Kosaka | F04D 29/687 |

FOREIGN PATENT DOCUMENTS

| | | | |
|---|---|---|---|
| EP | 0942175 | B1 | 11/2004 |
| EP | 2275689 | A1 | 1/2011 |
| EP | 2535594 | A1 | 12/2012 |
| EP | 1800009 | B1 | 1/2013 |
| EP | 2097313 | B1 | 7/2014 |
| EP | 2535677 | B1 | 4/2015 |
| EP | 2896838 | A1 | 7/2015 |
| EP | 1995466 | B1 | 5/2016 |
| EP | 1878923 | B1 | 4/2017 |
| EP | 2441963 | B1 | 10/2017 |
| EP | 2000676 | B1 | 12/2017 |
| JP | 3861008 | B2 | 12/2006 |
| JP | 2007107435 | A | 4/2007 |
| JP | 2010133297 | A | 6/2010 |
| JP | 4830519 | B2 | 12/2011 |
| JP | 4859204 | B2 | 1/2012 |
| JP | 5066835 | B2 | 11/2012 |
| JP | 6078945 | B2 | 2/2017 |
| WO | 2015005832 | A1 | 1/2015 |
| WO | 2015170401 | A1 | 11/2015 |
| WO | 2017126444 | A1 | 7/2017 |
| WO | 2019239174 | A1 | 12/2019 |

OTHER PUBLICATIONS

Hydronic Cassette Fan Coils Unit—IdroFan. Retrieved on Sep. 25, 2018 from https://www.bing.com/search?q=Hydronic+Cassette+Fan+Coil+Units+-+IdroFan&src=IE-TopResult&FORM=IETR02&conversationid=. 16 Pages.

International Search Report of the International Searching Authority; International Application No. PCT/US2019/058479; International Filing Date: Oct. 29, 2019; dated Jan. 15, 2020; 6 pages.

Multiaqua—Ceiling Cassetts Fan Coil Unit. Operation and Installation Manual. Retrieved on Sep. 25, 2018 from www.multiauqa.com. 21 Pages.

Written Opinion of the International Searching Authority; International Application No. PCT/US2019/058479; International Filing Date: Oct. 29, 2019; dated Jan. 15, 2020; 8 pages.

International Preliminary Report on Patentability; International Application No. PCT/US2019/058479; International Filing Date: Oct. 29, 2019; dated Apr. 27, 2021; 7 pages.

European Office Action; European Application No. 18306428.6-1007; dated Mar. 31, 2022; 7 pages.

* cited by examiner

ARRANGEMENT OF CENTRIFUGAL IMPELLER OF A FAN FOR REDUCING NOISE

CROSS REFERENCE TO RELATED APPLICATIONS

This application is a National Stage application of PCT/US2019/058479 filed Oct. 29, 2019, which claims priority to EP application 18306428.6 filed Oct. 31, 2018, both of which are incorporated by reference in their entirety herein.

BACKGROUND

Embodiments of the disclosure relate to a centrifugal fan, and more particularly, to the configuration of the flow path defined between the inlet shroud of an impeller and the inlet bell of an air intake.

Centrifugal fans are typically used in ventilation and air conditioning systems. Examples of common types of ventilation and air conditioning units include, but are not limited to, cassette type ceiling fans, air handling units, and extraction roof fans for example. Air is sucked into the unit and guided by a bell mouth intake into an impeller. A diameter of the bell mouth intake at the interface between the bell mouth intake and the inlet shroud of an impeller is smaller than a diameter of the blower at the interface. This inlet configuration has two effects. First, a clearance in fluid communication with the blower exists between the exterior of the bell mouth intake and the interior of the blower. As a result, a portion of the air output from the blower may recirculate to the impeller through this clearance, thereby reducing the operational efficiency of the fan, and increasing a noise level thereof. Second, the air entering the centrifugal fan has to skip a radial offset formed between the bell mouth and the inlet shroud, resulting in the formation of a vortex that can produce noise and decrease the operating efficiency of the fan.

BRIEF DESCRIPTION

According to an embodiment, an interface of a centrifugal fan includes an inlet shroud of an impeller and an air intake positioned adjacent the inlet shroud. The inlet shroud and the air intake cooperate to define a smooth flow path for an airflow entering the centrifugal fan.

In addition to one or more of the features described above, or as an alternative, in further embodiments the inlet shroud includes a first interior surface and the air intake includes a second interior surface, and the first interior surface and the second interior surface cooperate to define the smooth flow path.

In addition to one or more of the features described above, or as an alternative, in further embodiments the first interior surface and the second interior surface are aligned.

In addition to one or more of the features described above, or as an alternative, in further embodiments the air intake includes a bell mouth contour and an inner diameter at a distal end of the bell mouth contour is equal to or minimally smaller than an inner diameter of an adjacent portion of the inlet shroud.

In addition to one or more of the features described above, or as an alternative, in further embodiments the air intake is positioned in overlapping arrangement with a portion of the inlet shroud.

In addition to one or more of the features described above, or as an alternative, in further embodiments the air intake includes a distal end and the inlet shroud includes an inlet end, and an inner diameter at the distal end of the air intake is smaller than an inner diameter at the inlet end of the inlet shroud.

In addition to one or more of the features described above, or as an alternative, in further embodiments the air intake further comprises a sidewall, a bell mouth contour, and a gap defined between a portion of the bell mouth contour and the sidewall.

In addition to one or more of the features described above, or as an alternative, in further embodiments an inlet end of the inlet shroud is positioned within the gap.

In addition to one or more of the features described above, or as an alternative, in further embodiments the inlet shroud further comprises a first portion having a generally axial contour and a second portion having an arcuate contour.

In addition to one or more of the features described above, or as an alternative, in further embodiments a thickness of the first portion varies over an axial length of the first portion.

In addition to one or more of the features described above, or as an alternative, in further embodiments the inlet shroud and the air intake are formed from identical materials.

According to another embodiment, a centrifugal fan for use in an air conditioning device includes an impeller configured to rotate about an axis of rotation. The impeller has a plurality of blades and an inlet shroud mounted to a distal end of the plurality of blades. An air intake is positioned upstream from the impeller relative to a main airflow such that the air intake and the inlet shroud axially overlap. The air intake is contoured to direct the main airflow towards the impeller. The air intake and the inlet shroud cooperate to define a smooth flow path for an airflow entering the fan.

In addition to one or more of the features described above, or as an alternative, in further embodiments the smooth flow path does not include a lateral offset at an interface between the air intake and a downstream portion of the inlet shroud relative to the airflow.

In addition to one or more of the features described above, or as an alternative, in further embodiments the downstream portion of the inlet shroud overlaps with an extended profile defined by an interior surface of the air intake.

In addition to one or more of the features described above, or as an alternative, in further embodiments the air intake includes a first interior surface and the inlet shroud includes a second interior surface, and the first interior surface and the second interior surface cooperate to define the smooth flow path.

In addition to one or more of the features described above, or as an alternative, in further embodiments the first interior surface and the second interior surface are aligned.

In addition to one or more of the features described above, or as an alternative, in further embodiments the air intake further comprises a sidewall, a bell mouth contour, and a gap defined between a portion of the bell mouth contour and the sidewall.

In addition to one or more of the features described above, or as an alternative, in further embodiments an inlet end of the inlet shroud is positioned within the gap.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
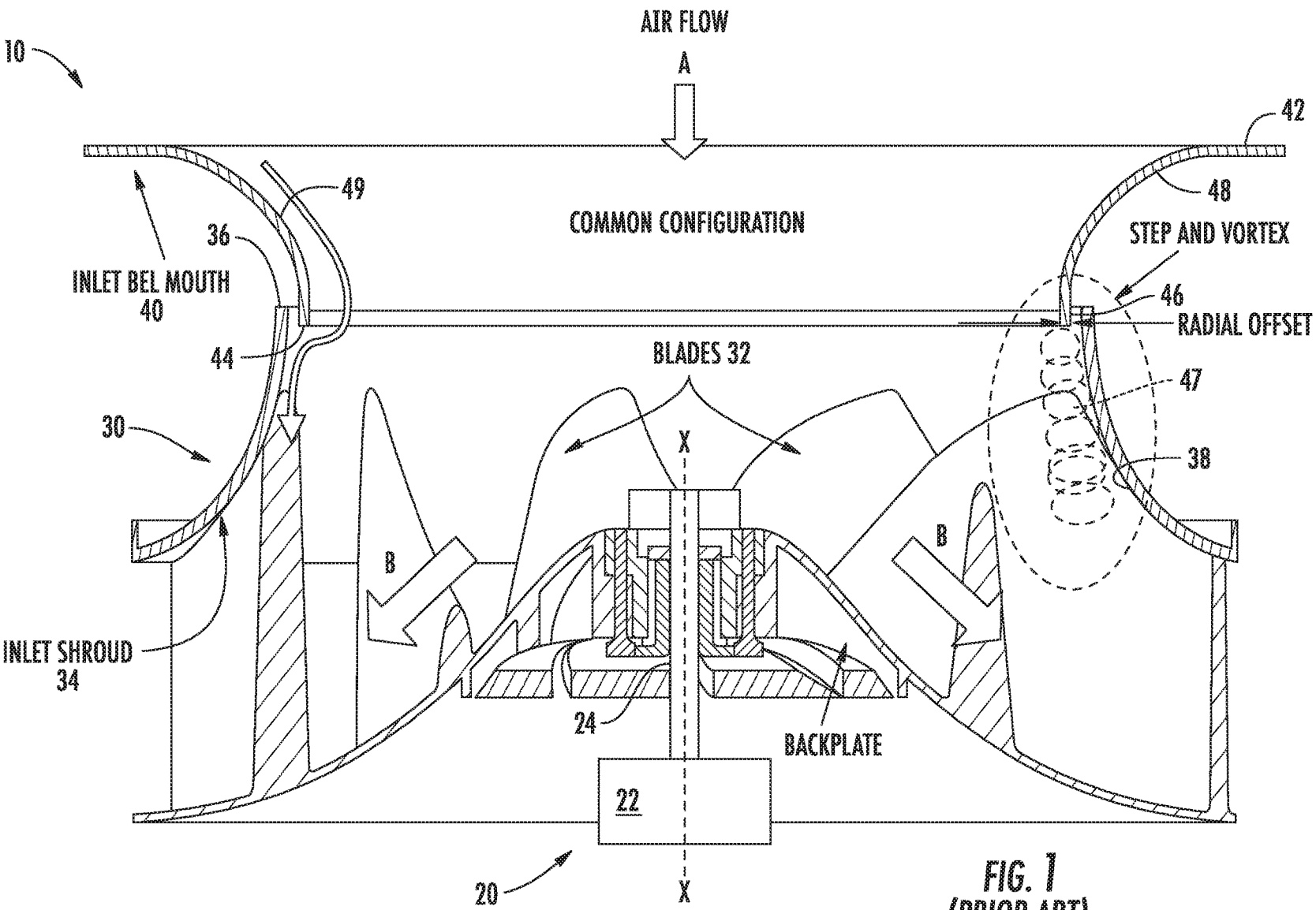
FIG. 1 (PRIOR ART)
FIG. 1 is a cross-sectional view of an example of an existing centrifugal fan as used in ceiling cassette type air conditioner.

With reference now to FIG. 1, an example of a centrifugal fan 10, such as commonly used in a ceiling cassette type air conditioner for example is illustrated. The centrifugal fan or blower 10 includes a fan motor, illustrated schematically at 20, and an impeller 30. The fan motor 20 includes a motor base 22 and a motor shaft 24 extending from the motor base 22 and configured to rotate about an axis X. The impeller 30 is mounted to the motor shaft 24 for rotation with the motor shaft 24 about the fan axis X. The impeller 30 includes a plurality of impeller blades 32 that are connected at a distal end via an inlet shroud 34.

The fan 10 additionally includes an air intake 40. As shown in FIG. 1, the air intake 40 is typically formed with a bell mouth, and is always arranged upstream from the inlet shroud 34 relative to the flow of air A through the fan 10. The air intake 40 includes a first end 42 and a second end 44, the second end 44 being substantially coplanar with, or alternatively, slightly overlapping an inlet end 36 of the inlet shroud 34.

During operation of the fan 10, the fan motor 20 is energized, causing the impeller 30 to rotate about the axis X. This rotation sucks air into the impeller 30 via the air intake 40, in the direction indicated by arrow A. Within the impeller 30, the axial air flow transitions to a radial air flow and is provided outwardly to an adjacent component, as indicated by arrows B, such as a heat exchanger (not shown) for example.

As shown, the diameter at the second end 44 of the air intake 40 is smaller than the diameter at the inlet end 36 of the inlet shroud 34. As a result, a radial offset or step 46 exists between the interior surface 49 of the air inlet 40 and the interior surface 38 of the inlet shroud 34. This step 46 can create a vortex 47 adjacent to the second end 44 of the air intake 40. As this vortex 47 interacts with the rotating impeller blades 32, excess noise may be generated. It is therefore desirable to reduce or minimize the noise of the fan 10 by reducing the vortex 47 created by the step 46 between the second end 44 of the air intake 40 and the interior surface 38 of the inlet shroud 34.

Figure 2:
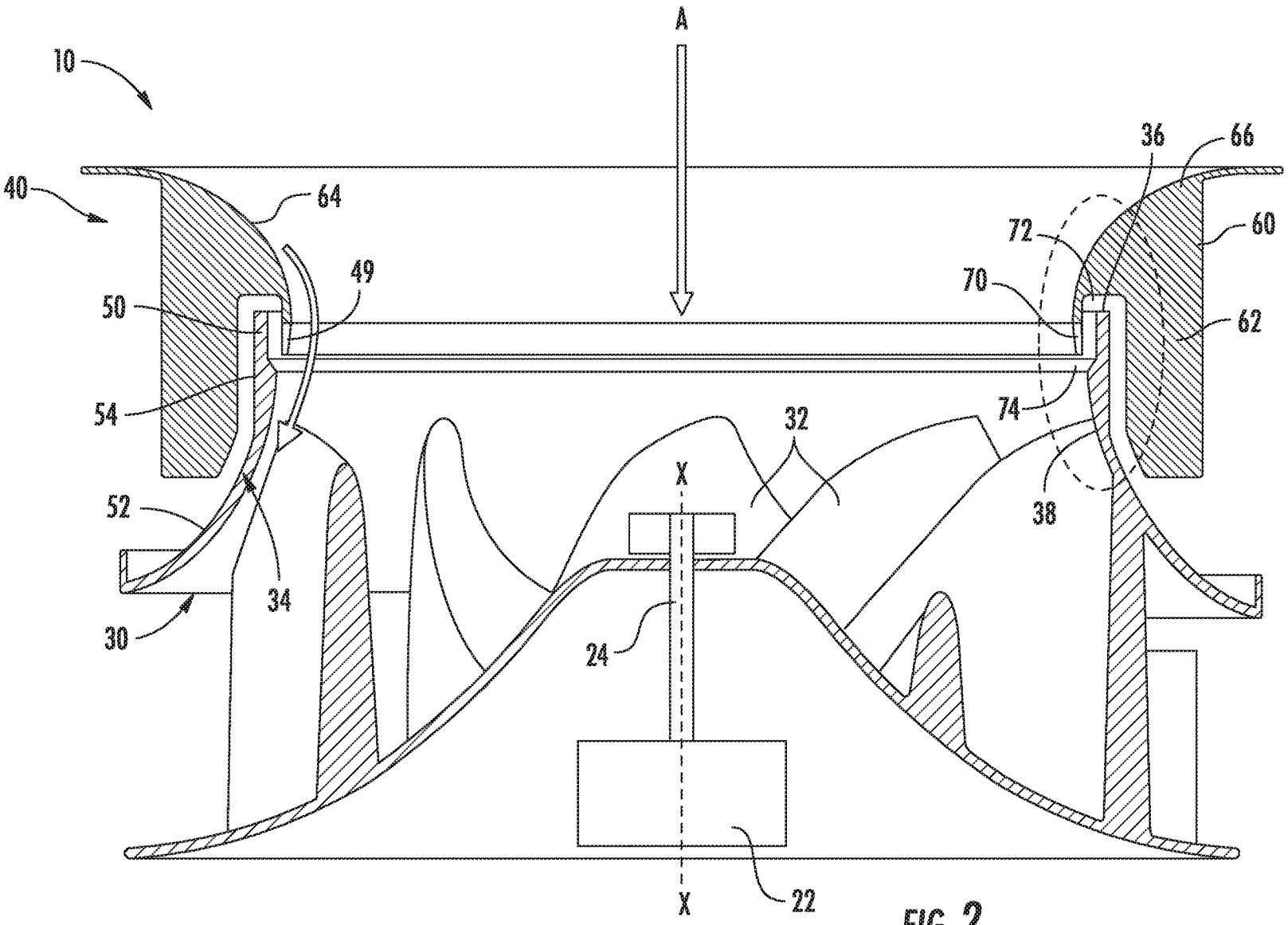
FIG. 2 is a cross-sectional view of an interface between an inlet shroud and an air intake of a centrifugal fan according to an embodiment.
Figure 3:
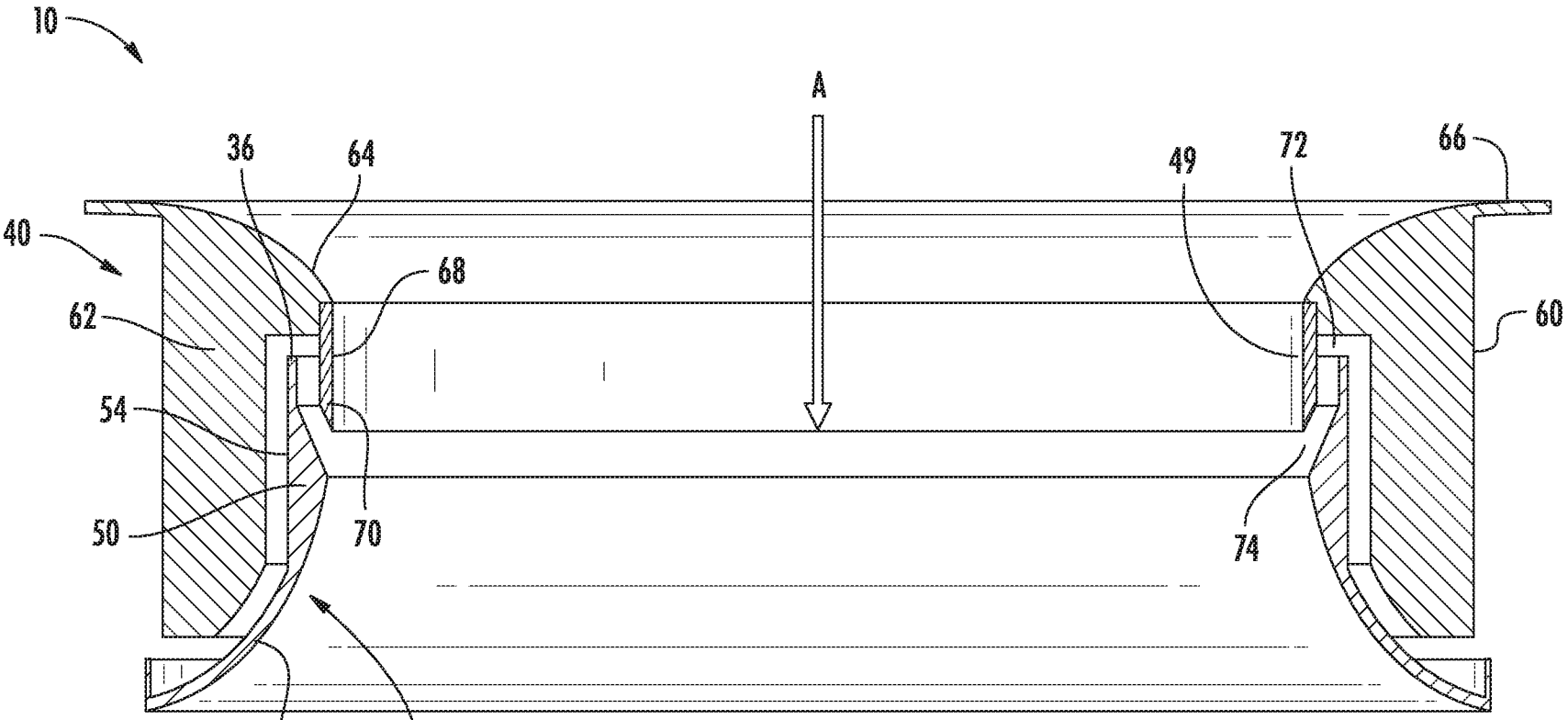
FIG. 3 is a cross-sectional view of an interface between an inlet shroud and an air intake of a centrifugal fan according to another embodiment.

With reference now to FIGS. 2 and 3, various examples of a configuration of a fan 10 having reduced noise generation are illustrated. As shown, the noise of the fan 10 may be reduced by eliminating the lateral offset or step 46 at the interface between the air intake 40 and the inlet shroud 34. Accordingly, the interior surface 49 of the air intake 40 and the interior surface 38 of an adjacent, downstream portion of the inlet shroud 34 cooperate to define a smooth flow path for the airflow A provided to the fan 10.

The internal profile of the inlet shroud 34 is similar to the inlet shroud of existing systems. As shown, the inlet shroud 34 has a generally arcuate contour such that a diameter of the inlet shroud 34 gradually increases in the direction of the airflow A. In the illustrated, non-limiting embodiment, the inlet shroud 34 includes a first portion 50 having a generally axial contour and second portion 52 having a curved or arcuate contour. The first portion 50 of the inlet shroud 34 extends linearly, such as in a vertically oriented axis for example, from the inlet end 36 of the inlet shroud 34. The axial length of the first portion 50, measured generally parallel to the axis of rotation X, may be generally equal to, greater than, or alternatively, less than the axial length of the second portion 52 of the inlet shroud 34. However, in an embodiment, the first portion 50 of the inlet shroud 34 typically extends vertically beyond the second end of the air intake 40.

In the illustrated, non-limiting embodiment, a thickness of the first portion 50 varies over the axial length of the first portion 50. In an embodiment, the thickness of the first portion 50 of the inlet shroud 34 gradually increases from adjacent the interface with the second portion 52 towards a center of the first portion 50. Similarly, the thickness of the first portion 50 gradually increases from adjacent the inlet end 36 of the inlet shroud 34 towards the center of the first portion 50. In an embodiment, the resulting thickness variation has a generally triangular-shaped contour. Further, in an embodiment, the exterior surface 54 of the first portion 50 has a linear configuration such that the variation in thickness is formed at an interior facing side of the first portion 50 of the inlet shroud 34. It should be understood that the configuration of the inlet shroud 34 illustrated and described herein is intended as an example only, and that any suitable inlet shroud 34 configuration is within the scope of the disclosure.

In existing systems, as shown in FIG. 1, the air intake 40 is typically defined by a thin piece of material, such as sheet metal or plastic for example, contoured to form a bell mouth shape. In the fan configuration of FIG. 2, however, the air intake 40 includes a generally axisymmetric body 60 defined by a linearly extending sidewall 62. A minimum thickness of the sidewall 62 may be determined by the manufacturing process used to form the air intake 40. In an embodiment, the minimum thickness of the sidewall 62 of the air intake 40 is sized to be compatible for manufacturing using a material such as expanded polystyrene or "PSE." Further, the maximum thickness may be determined by the free space within the fan 10.

As shown, the air intake 40 additionally includes a curved bell mouth contour 64 which defines the interior surface 49 of the air intake 40 and facilitates the flow of air towards the impeller 30. In the illustrated, non-limiting embodiment of FIG. 2, the bell mouth contour 64 is integrally formed with the inlet end 66 of the sidewall 62. However, in other embodiments, as shown in FIG. 3, at least a portion of the bell mouth contour 64 may be formed by a separate component 68 affixed to the sidewall 62.

In an embodiment, a distal end 70 of the bell mouth contour 64 is offset from the adjacent surface of the sidewall 62. As a result, a gap 72 is defined between the distal end 70 of the bell mouth contour 64 and the sidewall 62. In such embodiments, when the air intake 40 is installed relative to the impeller 30, the inlet end 36 of the inlet shroud 34 is received within this gap 72 such that the air intake 40 and the inlet shroud 34 axially overlap. It should be understood that the configuration of the air intake 40 illustrated and described herein is intended as an example only, and that any suitable configuration of the air intake 40 is also within the scope of the disclosure.

As shown, the distal end 70 of the bell mouth contour 64 is positioned in-line with a corresponding portion of the inlet shroud 34. More specifically, the distal end 70 of the bell mouth contour 64 is positioned relative to the inlet shroud 34 such that the interior surfaces of the bell mouth contour 64 and the inlet shroud 34 cooperate to define a smooth profile along which the air flow A may travel toward the impeller blades 32. For example, the interior surface 49 of the air intake 40 and the adjacent, downstream portion of the inlet shroud 34 are aligned to form a continuous profile. Accordingly, the interior surface 38 of the inlet shroud 34 is not radially offset from the interior surface 49 of the distal end 70 of the bell mouth contour 64.

In an embodiment, an inner diameter of the distal end 70 of the bell mouth contour 64 is substantially equal to or minimally smaller than the inner diameter of the portion of the inlet shroud 34 arranged adjacent and downstream from the distal end 70 of the bell mouth contour 64. Further, although a gap 74 exists between the distal end 70 of the bell mouth contour 64 and the adjacent, downstream portion of the inlet shroud 34, the profile defined by the inlet shroud 34 is a continuation of the profile of the air intake 40. For example, if the profile of the air intake 40 were extended beyond the gap 74, the profile would intersect with the adjacent, downstream portion of the inlet shroud 34.

By removing the radial offset or step 46 between the interior surface 49 of the air intake 40 and the interior surface 38 of the inlet shroud 34, the vortex adjacent the interface between the inlet shroud 34 and air intake 40 may be significantly reduced. Accordingly, the noise generated by the fan 10 is reduced while improving the aerodynamic characteristics of the fan 10. In addition, the air intake 40 and the inlet shroud 34 may be formed from the same material.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. An interface of a centrifugal fan, comprising:

an inlet shroud of an impeller; and an air intake positioned adjacent the inlet shroud, wherein an interior surface of the air intake and an adjacent portion of the inlet shroud are aligned and define a smooth flow path for an airflow entering the centrifugal fan;

wherein the air intake further comprises:

a sidewall; and a bell mouth contour, a distal end of the bell mouth contour being offset from an adjacent surface of the sidewall such that a gap is defined between the distal end of the bell mouth contour and the sidewall;

wherein an inlet end of the inlet shroud is arranged within the gap.

2. The interface of claim 1, wherein the adjacent portion of the air inlet shroud includes a second interior surface, and the interior surface and the second interior surface cooperate to define the smooth flow path.

3. The interface of claim 2, wherein the interior surface and the second interior surface are aligned.

4. The interface of claim 1, wherein an inner diameter at the distal end of the bell mouth contour is equal to or minimally smaller than an inner diameter of an adjacent portion of the inlet shroud.

5. The interface of claim 1, wherein the air intake is positioned in overlapping arrangement with a portion of the inlet shroud.

6. The interface of claim 5, wherein an inner diameter at the distal end of the air intake is smaller than an inner diameter at the inlet end of the inlet shroud.

7. The interface of claim 1, wherein the inlet shroud further comprises:

a first portion having a generally axial contour; and a second portion having an arcuate contour.

8. The interface of claim 7, wherein a thickness of the first portion varies over an axial length of the first portion.

9. The interface of claim 1, wherein the inlet shroud and the air intake are formed from identical materials.

10. A centrifugal fan for use in an air conditioning device comprising:

an impeller configured to rotate about an axis of rotation, the impeller having a plurality of blades and an inlet shroud mounted to a distal end of the plurality of blades; and an air intake positioned upstream from the impeller relative to a main airflow such that the air intake and the inlet shroud axially overlap, the air intake being contoured to direct the main airflow towards the impeller, wherein an interior surface of the air intake and an adjacent portion of the inlet shroud are aligned and define a smooth flow path for an airflow entering the fan;

wherein the air intake further comprises a sidewall and a bell mouth contour, a distal end of the bell mouth contour being laterally offset from an adjacent surface of the sidewall such that a gap is defined between the distal end of the bell mouth contour and the sidewall; and wherein an inlet end of the inlet shroud is arranged within the gap.

11. The fan of claim 10, wherein the smooth flow path does not include the lateral offset at an interface between the air intake and a downstream portion of the inlet shroud relative to the airflow.

12. The fan of claim 11, wherein the downstream portion of the inlet shroud overlaps with an extended profile defined by an interior surface of the air intake.

13. The fan of any of claim 10, wherein the air intake includes a first interior surface and the inlet shroud includes a second interior surface, and the first interior surface and the second interior surface cooperate to define the smooth flow path; and/or wherein the first interior surface and the second interior surface are aligned.

* * * * *